US005457465A

United States Patent [19]

Collier et al.

[11] Patent Number: 5,457,465

[45] Date of Patent: Oct. 10, 1995

[54] CONFORMAL SWITCHED BEAM ARRAY ANTENNA

[75] Inventors: Donald C. Collier, Newtown, Conn.; Timothy R. Holzheimer, Boulder, Colo.

[73] Assignee: Ball Corporation, Munice, Ind.

[21] Appl. No.: 91,693

[22] Filed: Sep. 1, 1987

[51] Int. Cl.[6] ..... H01Q 3/02

[52] U.S. Cl. ..... 342/374

[58] Field of Search ..... 342/374

[56] References Cited

U.S. PATENT DOCUMENTS

| | | | |
|---|---|---|---|
| 3,530,485 | 9/1970 | Radford | 342/374 |
| 3,531,803 | 9/1970 | Rosen | 342/374 |
| 3,816,830 | 6/1974 | Giannini | 342/374 |
| 3,821,740 | 6/1974 | Ehrlich | 342/374 |
| 3,922,685 | 11/1975 | Opas | 342/374 |
| 3,964,066 | 6/1976 | Nemit | 342/374 |
| 4,001,763 | 1/1977 | Heyningen | 342/374 |
| 4,010,474 | 3/1977 | Proveacher | 342/374 |
| 4,123,759 | 10/1978 | Hines et al. | 342/374 |
| 4,176,322 | 11/1979 | Kommrusch | 342/374 |
| 4,257,050 | 3/1981 | Ploussios | 342/374 |
| 4,451,831 | 5/1984 | Stangel et al. | 342/374 |
| 4,499,473 | 2/1985 | Rao | 342/374 |

*Primary Examiner*—David C. Cain
*Attorney, Agent, or Firm*—Gilbert E. Alberding

[57] ABSTRACT

A conformal switched beam array antenna (10) is provided which includes a plurality of antenna elements (14) that are mounted onto a curved (16) or a planar surface (28) and that are arranged into a plurality of arrays (22). The antenna elements (14) in each array (22) are arranged in a hexagonal array with one antenna element (14) in the center of each hexagonal array space. A plurality of multiple-throw switches (34), a RF power divider or power combiner (42), and a digital programmer (46) cooperate to select antenna elements (14) in the direction of a given target, and also cooperate to reduce the required number of phase shifters (40) and amplifiers (38 or 58) to a fraction of the total number of antenna elements (14).

40 Claims, 3 Drawing Sheets

CONFORMAL SWITCHED BEAM ARRAY ANTENNA

BACKGROUND OF THE INVENTION

1. Field of the Invention

The present invention relates to a steerable antenna array for use with aircraft, satellites and for use with radar systems. More particularly the present invention relates to antennas in which a plurality of antenna elements are mounted onto a curved surface and means is provided for selectively determining the direction in which signals are received and/or transmitted.

2. Description of the Prior Art

It is often desirable to form an assembly of antenna elements in the electrical and geometric arrangement so that the radiation from the arrangement add up to give a maximum field intensity in a particular direction or directions and cancel or substantially cancel in other directions. Each element of such an arrangement or array is an individual radiating element and is structurally separate from the others. The radiation pattern of an array in free space depends on: (1) the geometric arrangement of the individual elements, (2) the relative current phases in each element, (3) the relative magnitude of current in each, and (4) the radiation patterns of the individual elements. It should be added that the gain for a given number of antenna elements is increased by proper spacing of the elements up to a maximum but after the spacing reaches over one wavelength (0.95) this increase generally drops off.

One type of prior art antenna is the conformal phased array antenna. The conformal phased array antenna employs a plurality of antenna elements. The antenna elements are attached to a surface which may be curved at various locations thereof so that each antenna element points at a different elevation and at a different azimuth. In the conformal phased array a beam from such an array can be directed at various angles (between broadside and endfire values) by changing the progressive phase shift along the array. As known, if the phasing is changed continuously, the beam traverses or sweeps angular sectors and such scanning phased array antenna devices find a number of applications. Thus, generally a phase shifter is attached to each of the antenna elements. Depending upon the application, an amplifier is generally attached to each of the phase shifters. If the antenna is used for receiving RF signals, then a low noise amplifier is used; if the antenna is used for sending RF signals, then a high power amplifier is used; and if the antenna is used for both receiving and sending signals, then both a low noise amplifier and a high power amplifier are used. SPMT switches may be employed to render selective ones of the antenna elements effective in the receiving or in the transmitting of RF signals. The SPMT switches provide a means for effectively selecting some of the antenna elements for receiving signals, or for transmitting signals, while rendering other of the antenna elements ineffective.

There are two distinct and formidable disadvantages of conformal phased array antennas. One disadvantage is excessively high cost of fabrication. The excessive cost is inherent in that a separate RF amplifier and a separate phase shifter are required for each antenna element. Another disadvantage is that the conformal phased array antenna is energy inefficient in that RF energy is delivered to each antenna element without regard to whether it faces in the desired direction at a given time.

Another type of prior art antenna is the electronic switched beam array antenna. A switched beam array antenna overcomes the disadvantage of sending RF energy to antenna elements that are not facing in a direction that is useful at a given time. This is accomplished by switching some antenna elements out of the circuit. However, switched beam array antennas also have disadvantages. One disadvantage is that they are generally complex in design because of requiring a separate amplifier for each antenna element. The other disadvantage is that, because of the complexity of the RF power divider, switched beam array antennas are generally limited to frequencies below the S-band.

In one design of an electronic switched beam array antenna which operates at 1.5 GHz, forty-six antenna elements were connected to forty-six separate RF amplifiers. The RF network that connects each antenna element to a respective one of the amplifiers is generally bulky, labor-intensive, and difficult to manufacture. In yet another design, one hundred twenty antenna elements were employed along with one hundred twenty amplifiers. In addition to being expensive to manufacture, the RF feed network which divides the RF signal for each amplifier encountered significant energy losses above 2.0 GHz. In the aforementioned antenna arrays it was found that there was yet another significant problem that was due to beam crossing found in these prior types of arrangement.

SUMMARY OF THE INVENTION

In prior art antenna arrays there are severe beam crossing problems and such antennas had generally poor RF coverage at the horizon. These early antenna versions were configured in a pentagonal spacing configuration and, in practice, posed serious loss of gain at locations between the antenna element beam crossings. It was discovered that a particular arrangement employing a hexagonal spacing configuration to be described in more detail herein was highly effective in reversing this difficulty.

The present invention provides an antenna array for effective directional gain which comprises a supporting structure, one central antenna element connected to said structure and planetary antenna elements spaced from and surrounding said central antenna element in an arrangement such that the electromagnetic phase centers of said planetary antenna elements define a regular hexagon about said central antenna element. Such an arrangement of antenna elements greatly reduces the crossover problem and allows, in accordance with this invention, the proper steering and shaping of a radiation pattern in an effective and highly sensitive manner.

The present invention also includes a plurality of antenna elements that are disposed onto a curved surface with two control devices, or selecting devices. One of the control devices is a bank of single-pole, multiple-throw switches; and the other control device is a RF power divider or power combiner.

When the present invention is used in a leading edge of an aircraft wing, for example, the curvature is primarily in the elevation plane, and a plurality of antenna elements are implanted in the surface of the wing on the bottom, a plurality are implanted in the leading edge, and a plurality are implanted in the upper surface. In order to scan an electromagnetic beam such as a radar beam in the elevation plane, the array of elements most nearly pointing in the desired direction is activated. For instance, to direct the electromagnetic beam straight up while the aircraft is flying straight and level, an array on the upper wing surface is activated and to direct the electromagnetic beam straight down, an array on the lower wing surface is activated. Furthermore, to point horizontally, an array on the leading edge is activated and for elevations above or below horizontal, the array most nearly pointing at the desired elevation is activated.

However, each array activated in turn from the top around to the bottom of the wing cannot cover, with equal electromagnetic intensity, all desired elevation angles. Between the beam angle of one array and the beam angle of the next array there exist small sectors of weaker radiation called beam crossover areas.

Phase shifters are generally incorporated in the RF feed lines to change the phase of the RF energy traveling to the antenna elements of the array which is energized by the multiple-throw switches. These phase shifters shift the direction of the electromagnetic beam slightly and thus fill in the crossover points. In this manner, all points in an elevation plane above, in front of, and below the aircraft wing can be illuminated with approximately the same amount of RF power.

These same phase shifters can also be used to scan the beam of the electromagnetic energy to one side or the other of the elevation plane. For example, if an array of elements on the leading edge of the aircraft wing were energized and were pointing an electromagnetic beam toward the horizon, the electromagnetic beam could be scanned back and forth in the azimuth plane by changing the phase of the RF signals.

More specifically, in the present invention, an antenna is provided which includes a plurality of antenna elements that are disposed onto a curved surface. The curved surface may be a spherically shaped surface; or the curved surface may be any curved surface, such as the leading edge of an airfoil, as described above, or a portion of the fuselage of an aircraft.

Preferably the antenna elements are arranged in arrays of seven antenna elements (a hexagonal configuration), each having a sun element at the center and six planetary elements that are equidistant from the sun element and from each other. Also, each planetary element of each array is equidistant to adjacent ones of planetary elements of an adjacent array. Thus, each antenna element is equidistant from all antenna elements that are adjacent thereto.

The antenna of the present invention includes a plurality of multiple-throw switches, each of which is connected to a like-positioned antenna element of each one of the antenna arrays. That is, if the antenna elements in the arrays are lettered "a" through "g," with antenna element "a" being the sun element, then one multiple-throw switch is connected to all of the "a" elements.

Thus, the number of multiple-throw switches is one-seventh of the total number of antenna elements for an antenna in which each array includes seven antenna elements.

An amplifier is connected to each of the multiple-throw switches; so that each amplifier serves to amplify the signals sent to, or received from, one of the selected seven antenna elements.

A true-time-delay phase shifter is connected to each of the amplifiers; and each phase shifter serves one of the selected seven antenna elements, just as each amplifier serves one of the selected seven antenna elements.

A RF power divider, or a RF power combiner, is connected to each of the phase shifters and to a single RF conductor; and so the multiple-throw switches cause each arm of the RF power divider, or RF power combiner, to serve seven antenna elements.

A digital controller is provided and serves both to actuate the multiple-throw switches and to control the phase shifters so that any array of antenna elements can be selected; so that any other combination of antenna elements may be selected that are switchable by the multiple-throw switches; and so that the phase angles of a plurality of antenna elements may be changed selectively.

The use of the multiple-throw switches reduces the number of RF signals that must be divided or combined by the RF power divider, or RF power combiner, to one-seventh of the total number of antenna elements, reduces the number of amplifiers to one-seventh of the total number of antenna elements, and reduces the number of phase shifters to one-seventh of the total number of antenna elements, thereby reducing the cost of the antenna significantly over the prior art.

Not only does the present invention provide a significant decrease in cost, but also the present antenna is capable of operation at higher frequencies. The reason for this is that, with the reduction in the number of feed arms to one-seventh of the total number of antenna elements, the feed arms of the RF power divider, or RF power combiner, can be properly spaced apart from each other farther in accordance with this invention, thereby reducing crossover in RF power between the feed arms.

It is a primary object of the present invention to provide an antenna which is relatively simple and economical to manufacture, which is capable of functioning efficiently at high frequencies, and which has substantially equal sensitivity at elevations and azimuths that are intermediate of the individual antenna elements.

It is another primary object of the present invention to provide an antenna array in which the total number of antenna elements are selectively connected to a single conduit by means of two selecting means, neither of which selects, divides, or combines the RF signals of more than 1/7th of the total number of antenna elements.

It is an object of the present invention to utilize multiple-throw switches in conjunction with RF power dividers, or RF power combiners, to selectively connect a plurality of antenna elements to a single RF conductor.

It is an object of the present invention to utilize one amplifier for more than one antenna element.

It is an object of the present invention to utilize one phase shifter for more than one antenna element.

It is an object of the present invention to utilize multiple-throw switches in conjunction with RF power dividers, or RF power combiners, to utilize one amplifier for more than one antenna element.

It is an object of the present invention to utilize multiple-throw switches in conjunction with RF power dividers, or RF power combiners, and to utilize one phase shifter for more than one antenna element.

It is an object of the present invention to provide a superior spacing of antenna elements on a curved surface so that crossover points are substantially reduced.

It is an object of the present invention to space a plurality of antenna elements in a pattern in which each antenna element is equidistant from adjacent ones of the antenna elements.

It is an object of the present invention to space a plurality of antenna elements into arrays, and to electrically switch antenna elements from two adjacent arrays into a similarly spaced, or an identically-spaced, array.

It is an object of the present invention to space a plurality of antenna elements into arrays of antenna elements such that an electrically switched array, having identical spacing of antenna elements, may be formed from the antenna elements of two adjacent arrays, and that an electrically switched array cannot include two like-positioned antenna elements of the adjacent arrays thereof.

Finally, it is an object of the present invention to space a plurality of antenna elements into arrays of antenna elements with each array having a sun element and six planetary elements, and with each antenna element being equidistant from all adjacent antenna elements.

DESCRIPTION OF THE PREFERRED EMBODIMENTS

Figure 1:
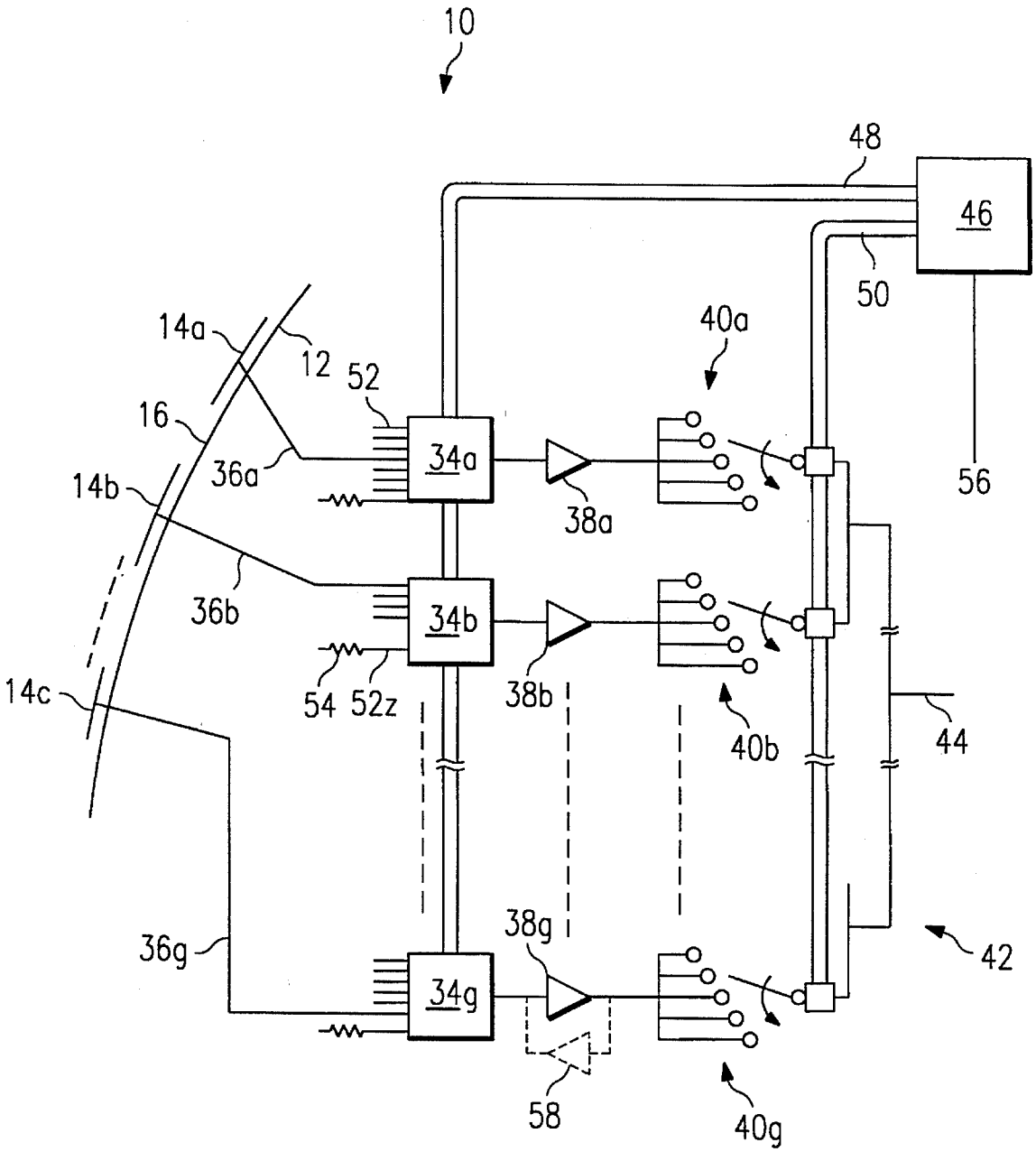
FIG. 1 is a simplified schematic drawing of the conformal switched spherical array antenna of the present invention, showing only a portion of the hemispherical shell thereof.
Figure 3:
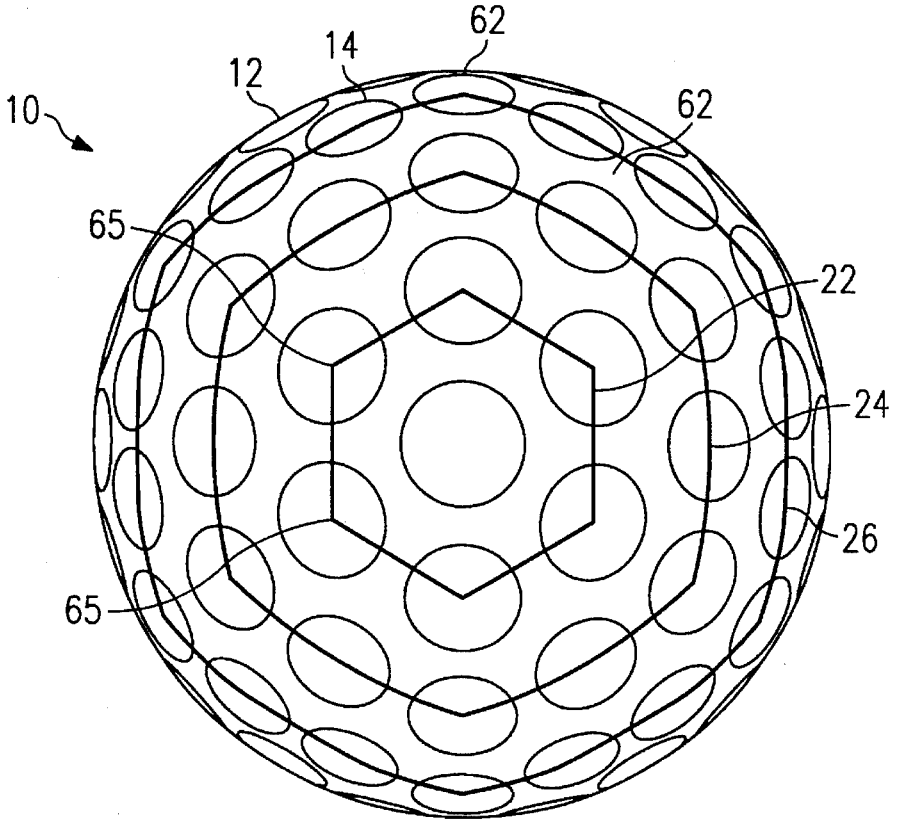
FIG. 3 is a top view of the present invention with the antenna elements arranged in hexagonal arrays on a hemispherical shell, and illustrating concentricity of different sizes of hexagonal arrays.
Figure 4:
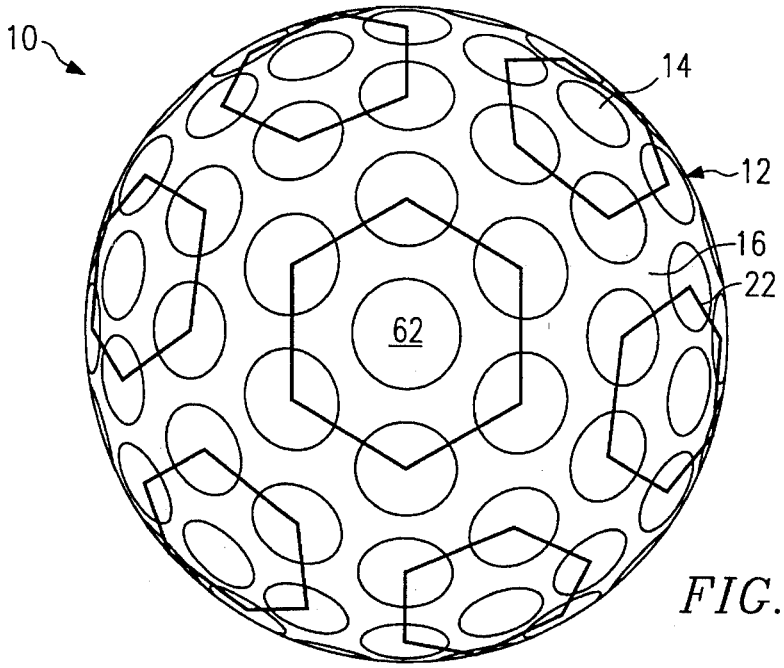
FIG. 4 is another top view of the embodiment of FIG. 3, illustrating the relative positioning of hexagonal arrays of the antenna elements.

Referring now to the drawings, and more particularly to FIGS. 1, 3, and 4, a conformal switched beam array antenna 10 includes a hemispherical shell or curved surface 12 and a plurality of antenna elements 14 which are mounted onto a curved surface, or spherically shaped surface, 16 of the hemispherical shell or curved surface 12.

Figure 2:
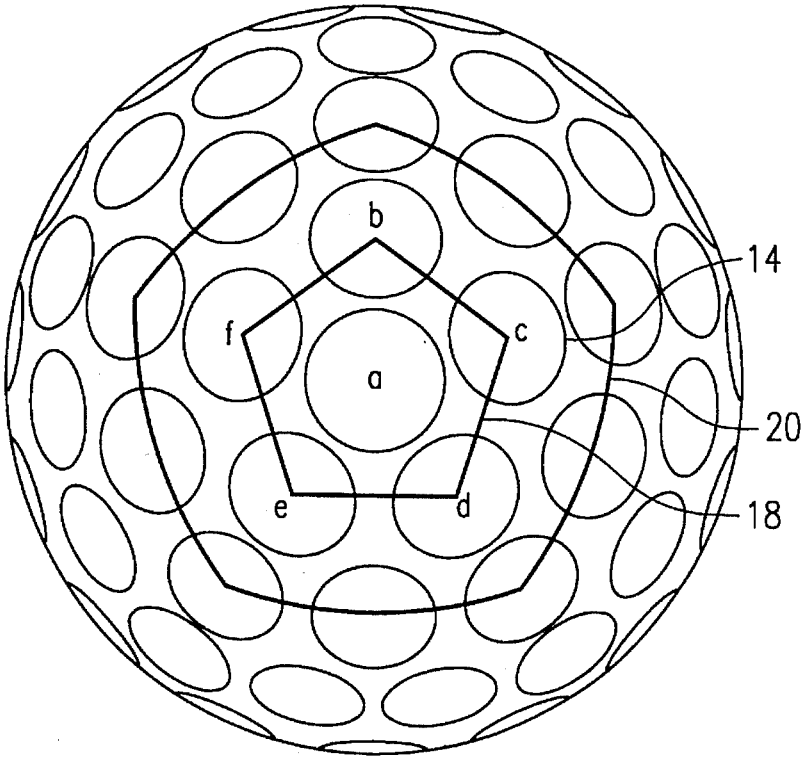
FIG. 2 is a top view of a prior art antenna of the electronic switching spherical array tube in which the antenna elements are arranged in concentric pentagonal arrays on a hemispherical shell.

Referring now to FIG. 2, in a prior art, antenna elements 14 were arranged in a primary array 18 which was pentagonal in shape (as drawn by lines connecting the phase centers 65), which included a sun element 14*a* and five planetary elements 14*b*–14*f*. This prior art arrangement of the antenna elements 14 also included a secondary array 20 which was pentagonal in shape, which included all of the antenna elements 14 of the primary array 18, and which included ten additional planetary elements 14.

Referring now to FIGS. 3 and 4, in a preferred embodiment of the present invention, the antenna elements 14 are arranged in antenna arrays configured in hexagonally shaped arrays, 22. The initial array is shown with seven of the antenna elements 14. It is possible to use as large a grouping as needed of the individual antenna elements, without changing the hexagonal shape of the cluster or arrangement. The general equation for the possible total number of antenna elements in a hexagonal cluster is f(n).

$$f(n) = 1 + \sum_{n=0}^{N} (6n) = 1 + 6 + 12 \ldots \quad N = 0, 1, 2 \ldots$$

FIG. 3 illustrates that it is possible to electrically switch the antenna elements 14 into secondary arrays 24 which include the seven antenna elements 14 of one array 22 and twelve more antenna elements 14. Also, the antenna elements 14 can be electrically switched into tertiary arrays 26 which include the nineteen antenna elements 14 of the secondary array 24 and eighteen additional antenna elements 14.

FIG. 4 illustrates, in accordance with the subject invention, the relationship of the hexagonally shaped arrays 22 to each other.

Figure 5:
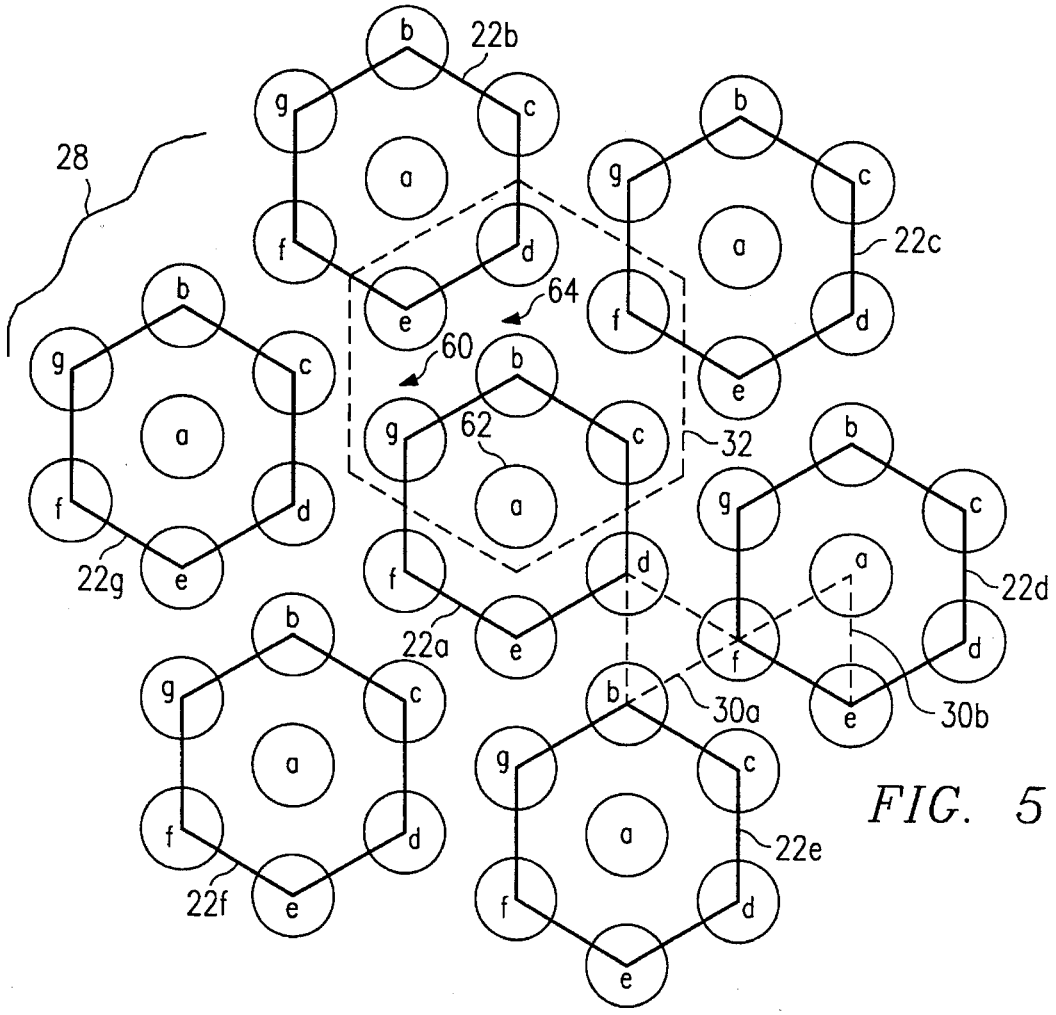
FIG. 5 is an enlarged scale layout of the antenna elements of FIGS. 3 and 4 on a flat surface, illustrating the relative positioning of respective ones of the antenna elements in adjacent ones of the hexagonal arrays, and illustrating the relationship of antenna elements in electrically-switched arrays that include antenna elements in adjacent ones of the arrays.

Referring now to FIG. 5, the hexagonally shaped arrays 22 of FIGS. 3 and 4 are shown mounted onto a planar surface 28 to more clearly show the relative location of the arrays 22 and the relative positions of respective ones of the antenna elements 14 in each array 22.

Antenna elements 14 have been designated with letters "a" through "g" so that the antenna elements 14 of any of the arrays 22 may be designated 14*a*–14*g*. The antenna elements 14*a* are the sun elements in each of the arrays 22; and the antenna elements 14*b* through 14*g* are the planetary elements.

Each antenna element 14 of FIGS. 3–5 is equidistant from adjoining ones of the antenna elements 14 in a given array and forms an equilateral triangle 30*a*, such as is formed by the antenna elements 14*a*, 14*e*, and 14*f* in the array 22*d* of FIG. 5.

Further, the positioning of the arrays 22 to one another is such that equilateral triangles 30*b* are formed by antenna elements 14 of adjacent ones of the arrays 22, such as is formed by the antenna element 14*b* of the array 22*e*, the antenna element 14*d* of the array 22*a*, and the antenna element 14*f* of the array 22*d*.

Referring again to FIG. 3, because of the equidistant spacing of each antenna element 14 from all adjacent ones of the antenna elements, it is possible to electrically form an array 22, a secondary array 24, or a tertiary array 26 that faces in any direction within the limitations of the total number of antenna elements 14 and the shape of the shell 12.

Referring again to FIG. 5, because of the hexagonal shape of the arrays 22, and because of the equilateral spacing of every antenna element 14 from all adjacent antenna elements 14, it is possible to form electrically switched arrays 32 which are hexagonally shaped, which include a sun element 14*b* and six planetary elements 14*a*, 14*c*–14*g* and which include antenna elements 14 from more than one of the arrays 22.

Thus, it is possible to form an array, 22 or 32, that points in any direction within the limitations of the spacing of the antenna elements 14, the total number of antenna elements 14, and the shape of the surface, such as the spherically-shaped surface or curved surface 16 of FIGS. 3 and 4.

Any electrically switched array 32 will include one each of the antenna elements 14*a*–14*g* without regard to the arrays 22 from which the antenna elements 14*a*–14*g* are selected. For instance, the electrically switched array 32 includes antenna elements 14*a*, 14*b*, 14*c* and 14*g* from the array 22*a*, includes the antenna elements 14*d* and 14*e* from the array 22*b*, and includes the antenna element 14*f* from the array 22c.

The discussion which follows will describe the electronic components and circuitry which achieve this selective switching of the antenna elements into a hexagonally shaped arrays, 22 or 32.

Referring now to FIGS. 1, 4, and 5, and more particularly to FIG. 1, the conformal switched beam array antenna 10 includes the hemispherical shell 12, antenna elements 14*a*, 14*b*, through 14*g*, multiple-throw switches 34*a*–34*g* which are connected to all of the antenna elements 14*a*–14*g* respectively by respective ones of coaxial conductors 36*a*–36*g*, low noise amplifiers 38*a*–38*g* which are connected to respective ones of the multiple-throw switches 34*a*–34*g*, true-time-delay phase shifters 40*a*–40*g* of the pin diode type that are connected to respective ones of the low noise amplifiers 38*a*–38*g*, a seven-way RF power combiner or power divider 42 that is connected to the phase shifters 40*a*–40*g*, and a single RF conductor 44.

A digital controller 46 is connected to the multiple-throw switches 34*a*–34*g* by a ribbon conductor 48; and the digital controller 46 is connected to the pin diode phase shifters 40*a*–40*g* by a ribbon conductor 50.

Each of the multiple-throw switches 34 has one switch position (not shown) and one switched conductor 52 for each of the arrays 22 and an extra position (not shown) and an extra switched conductor 52*z*. A dummy antenna load 54 is attached to each of the switched conductors 52*z* for testing and tuning purposes.

The digital controller 46 includes a command conductor 56 which is used to control the digital controller 46. The digital controller 46 may be programmed to actuate the multiple-throw switches 34 to any combination of positions. Thus, the conformal switched beam array antenna 10 can be programmed to connect all possible combinations of the antenna elements 14 to the single RF conductor 44.

The possible combinations include selecting any one of the antenna elements 14*a*, any one of the antenna elements 14*b*, etc. In addition the possible combinations include switching one or more of the multiple-throw switches 34 to the dummy antenna loads 54. By switching some of the multiple-throw switches 34 to the dummy antenna loads 54 thereof it is possible to shape the pattern of antenna sensitivity to a fan shape, or other desired shape.

When the conformal switched beam array antenna 10 is used as a receiving antenna, a receiver (not shown) is attached to the single RF conductor 44; but when the antenna 10 is used as a transmitting antenna, high power amplifiers 58, as shown by phantom lines, are used in place of low noise amplifiers 38, the RF power combiner 42 becomes a RF power divider, and a transmitter (not shown) is attached to the single RF conductor 44.

The digital controller 46 is programmed to select an array 22, or an electrically switched array 32, that most nearly points the RF wave toward the target (not shown), if transmitting, or that most nearly maximizes sensitivity of the antenna toward the received RF wave, if receiving a signal.

If the selected array, 22 or 32, is not pointing directly toward the target, the RF beam may be shifted by use of the phase shifters 40. For instance, if a point 60 (FIG. 5) were pointing directly toward the target, then by energizing the array 22*b*, and by biasing the phase shifters 40 to produce a progressive phase front to the RF energy, the array 22*b* acts as a small conventional phased array antenna whose receive-beam points slightly down from a hemisphere zenith 62 of FIGS. 4 and 5.

Or, if a point 64 were pointing directly toward the target, then by energizing the array 32, and by biasing the phase shifters 40 to produce a progressive phase front to the RF energy in the opposite direction from that of the previous example, the array 32 acts as a conventional phased array antenna whose receive-beam points slightly away from the hemisphere zenith 62.

In either case, the conformal switched beam array antenna 10 loses little energy and is capable of scanning a full half hemisphere without the troublesome crossover holes that have been inherent in prior state of the art antennas of the electronically switched spherical array type.

The phase shifters 40 were used in the previous examples to make beam positional adjustments in the elevation plane. However, because of the symmetrical nature of the arrays, 22 and 32, it is equally possible to make positional adjustments in the azimuth plane, or for that matter, in both the azimuth and elevation planes at the same time.

Therefore, the combination of the multiple-throw switches 34 and the phase shifters 40 provides pointing flexibility that is lacking in antennas of the electronically switched spherical array type. This feature permits the present invention to be mounted into the leading edge of an aircraft and used to scan both elevation and azimuth, as previously mentioned.

In a common design made according to the teaching of the present invention, forty-six antenna elements 14 are mounted onto a spherically-shaped surface 16, are connected to seven multiple-throw switches 34, to seven amplifiers, 38 or 58, to seven phase shifters 40, to a seven-way RF power combiner or power divider 42, and to a single RF conductor 44. In an antenna of the electronically switched spherical array type it would have been necessary to use forty-six amplifiers and forty-six phase shifters to achieve the same results.

In instances where seven antenna elements 14 do not provide sufficient gain, the arrays 22 are enlarged to include the next peripheral row of antenna elements 14 in the array 24 of FIG. 3, or if still more sensitivity is required, the array 24 can be enlarged to include eighteen more amplifiers 14 in the array 26.

Further, in very large antennas, the principles of the present invention can be used to include even larger numbers of the antenna elements 14 in arrays. It is possible to use as large a number of antenna elements 14 in an array as the sensitivity requires, as long as the total number of antenna elements, the curvature of the spherically-shaped surface, leading edge surface, etc. permits.

Whatever the number of antenna elements 14 in an array, the combination of multiple-throw switches 34 and one or more RF power dividers 42 achieves the desired antenna gain and flexibility of pointing as described above, together with the advantages of utilizing RF power dividers 42 that are simpler and that will function at higher frequencies, of reducing the number of amplifiers, 38 or 58, that are required, and of reducing the number of phase shifters 40 that are required.

The present invention functions efficiently up to and including the Ku band; whereas, in prior art designs of the electronically switched spherical array type of antenna, the complexity of design and proximity of the arms of the power divider limited operation to below S-band frequencies. In contrast, the limitation of frequency of the present invention is the frequency limitation of the multiple-throw switches; and multiple-throw switches are commercially available that will function up to twenty GHz.

In summary, the present invention arranges a plurality of antenna elements 14 into arrays 22. Preferably the arrays 22 are hexagonal in shape and include seven antenna elements 14 which are equidistant one to another. Preferably the arrays 22 are positioned, one to another, so that every antenna element 14 is equidistant to adjacent ones of the antenna elements.

However, some of the advantages of the present invention will accrue with other numbers of antenna elements in an array and in other spacings of antenna elements in each array, even though the spacing between all of the antenna elements 14 may not be equal.

The present invention utilized multiple-throw switches 34 and one or more RF power dividers or power combiners 42 to connect selective ones of antenna elements 14 to a single RF conductor, thereby reducing the number of amplifiers, 38 or 58, that are required to a fraction of the total number of antenna elements 14, and also reducing the number of phase shifters 40 that are required to a fraction of the total number of antenna elements 14.

The present invention utilizes phase shifters in cooperation with the multiple-throw switches, so that the beam pointing angle of a selected array, 22 or 32, of the antenna elements 14 may be deflected slightly, thereby effectively eliminating crossover holes in sensitivity.

The RF power divider, or RF power combiner, 42 cooperates with a plurality of multiple-throw switches 34 as a connecting means for connecting a plurality of antenna elements 14 to a single RF conductor 44; and the multiple-throw switches 34 serve as a reselecting means for disconnecting and connecting selected ones of the antenna elements 14 to the single RF conductor 44.

While specific apparatus has been disclosed in the preceding description, it should be understood that these specifics have been given for the purpose of disclosing the principles of the present invention and that many variations thereof will become apparent to those who are versed in the art. Therefore, the scope of the present invention is to be determined by the appended claims.

Industrial Applicability

The present invention is applicable to receiving and transmitting antennas for use with radar systems, satellite communications, and other types of communication systems.

What is claimed is:

1. An antenna array for providing effective directional gain comprising:

a supporting structure;

a plurality of antenna elements, said elements positioned on said support structure to define at least tow sub-arrays, each sub-array including one central antenna element secured to said structure and six planetary antenna elements connected to said structure and spaced from said central antenna element in an arrangement such that said planetary antenna elements define a regular hexagon about said central antenna element, wherein each of said sub-arrays may selectively provide, through the operative cooperation and contribution of its planetary antenna elements and central antenna element, effective directional gain about an axis passing through the hexagon defined by the planetary antenna elements of the sub-array;

at least one amplifier, wherein the number of said amplifiers is less than the number of said antenna elements; and means for selectively connecting at least said one amplifier to one of said antenna elements in at least each of said two sub-arrays.

2. An antenna array as defined in claim 1 wherein the total number of antenna elements in the arrangement including said central antenna element satisfied the equation:

$$1 + \sum_{n=0}^{N} (6n)$$

where N is zero or a whole positive integer.

3. An antenna array as recited in claim 1 where in the supporting structure is curved.

4. An antenna array as recited in claim 1 wherein the antenna elements are conformal.

5. An antenna which comprises:

a plurality of antenna elements being disposed in a predetermined pattern defining at least two sub-arrays, each sub-array including a central antenna element and six planetary antenna elements spaced from said central antenna element such that said planetary elements define a regular hexagon about said central antenna element, and wherein each of said sub-arrays may selectively provide, through the operative cooperation and contribution of its planetary antenna elements and central antenna element, effective directional gain about an axis passing through the hexagon determined by the planetary elements of the sub-array;

connecting means for connecting selected ones of said antenna elements to a single RF conductor;

reselecting means for disconnecting one of said selected antenna elements from said RF conductor, and for connecting a different one of said antenna elements to said RF conductor;

at least one phase shifter, wherein the number of said phase-shifters is less than the number of said antenna elements; and means for selectively connecting at least said one phase shifter to one of said antenna elements in at least each of said two sub-arrays.

6. An antenna as claimed in claim 5 wherein:

each of said antenna elements are assigned to one of a number of groups, said number of groups being less than the number of antenna elements, and wherein said means for selectively connecting is operative to connect each of said phase-shifters to antenna elements in one of said groups without connection to any antenna elements in another of said groups.

7. An antenna as claimed in claim 6 in which said reselecting means comprises one or more multiple-throw switches; and each of said multiple-throw switches is connected to at least one of said antenna elements in each of said groups and to said connecting means.

8. An antenna as claimed in claim 5 in which said connecting means comprises a RF power combiner.

9. An antenna as claimed in claim 5 in which said connecting means comprises a RF power divider.

10. An antenna as claimed in claim 5 in which said antenna includes a phase shifter being interposed between one of said antenna elements and said single RF conductor.

11. An antenna as claimed in claim 5 in which said antenna includes an amplifier being interposed between one of said antenna elements and said single RF conductor.

12. An antenna as claimed in claim 5 in which said reselecting means comprises a multiple-throw switch and a digital controller that is operatively connected to said multiple-throw switch.

13. An antenna as claimed in claim 5 in which said antenna elements are mounted onto a curved surface.

14. An antenna as claimed in claim 5 in which said antenna elements are mounted onto a spherically shaped or curved surface.

15. An antenna as claimed in claim 6 in which said predetermined pattern of antenna elements comprises a plurality of antenna arrays each having a plurality of said antenna elements therein; and said reselecting means comprises a multiple-throw switch that is interposed between at least one of said antenna elements in each of said groups and said single RF conductor.

16. An antenna as claimed in claim 15 in which said antenna includes means, comprising said multiple-throw switch, for selecting at least two of said antenna elements from different ones of said sub-arrays, and for connecting said selected antenna elements to said single RF conductor.

17. An antenna as claimed in claim 15 in which said antenna includes means, comprising said multiple-throw switch, for selectively connecting one of said antenna arrays to said RF conductor, and for selectively connecting another of said antenna arrays to said RF conductor.

18. An antenna as claimed in claim 15 in which at least two of said antenna sub-arrays each include seven antenna elements that are equidistantly spaced from each other.

19. An antenna as claimed in claim 15 in which at least two of said antenna sub-arrays each include a sun antenna element and six planetary antenna elements; and said planetary antenna elements are equidistantly spaced from said sun antenna element and from each other.

20. An antenna as claimed in claim 15 in which at least two of said antenna sub-arrays each include seven antenna elements that are equidistantly spaced from each other; and said antenna includes means, comprising said multiple-throw switch, for selecting seven of said antenna elements from different ones of said sub-arrays; and for connecting said selected antenna elements to said single RF conductor.

21. An antenna as claimed in claim 15 in which at least two of said antenna sub-arrays each include a sun antenna element and six planetary antenna elements;

said planetary antenna elements are equidistantly spaced from said sun antenna element and from each other;

said antenna include means, comprising said multiple-throw switch, for selecting seven of said antenna elements from different ones of said sub-arrays, and for connecting said selected antenna elements to said single RF conductor.

22. An antenna as claimed in claim 15 in which said antenna includes means, comprising said multiple-throw switch, for selectively achieving an electrically-switched beam array that includes an antenna element from at least two adjacent ones of said antenna sub-arrays.

23. An antenna as claimed in claim 15 in which said antenna includes means, comprising the number of said antenna elements in at least two adjacent ones of said sub-arrays, and comprising said multiple-throw switch, for selectively achieving an electrically-switched array that includes one of said antenna elements from each of said adjacent sub-arrays, and that has the same number of antenna elements as either of said adjacent sub-arrays.

24. An antenna as claimed in claim 15 in which said antenna includes means, comprising the spacing of said antenna elements in adjacent ones of said antenna sub-arrays, and comprising said multiple-throw switch, for selectively achieving an electrically-switched beam sub-array that includes similarly-spaced antenna elements and that includes an antenna element from said adjacent sub-arrays.

25. An antenna as claimed in claim 15 in which said antenna includes means, comprising the number and spacing of said antenna elements in adjacent ones of said antenna sub-arrays and relative spacing between said adjacent sub-arrays, and comprising said multiple-throw switch, for selectively achieving an electrically-switched sub-array that is substantially identical to one of said adjacent sub-arrays.

26. An antenna as claimed in claim 15 in which at least two adjacent ones of said antenna sub-arrays each include seven antenna elements;

said antenna elements are equidistantly spaced in at least two said adjacent sub-arrays; and said antenna include means, comprising said multiple-throw switch, for selectively achieving an electrically-switched beam sub-array that includes at least one of said antenna elements from said adjacent sub-arrays, and that includes seven antenna elements that are equidistantly spaced from each other.

27. An antenna as claimed in claim 15 in which at least two adjacent ones of said antenna sub-arrays each include a sun antenna element and a plurality of planetary antenna elements that are disposed around said sun antenna element; and said antenna include means, comprising said multiple-throw switch, for selectively achieving an electrically-switched sub-array that includes said sun antenna element of one of said adjacent sub-arrays, at least one of said planetary antenna elements of said one adjacent sub-array, and at least one of said planetary antenna elements of the other of said adjacent sub-arrays.

28. An antenna as claimed in claim 15 in which at least two adjacent ones of said antenna sub-arrays each include a sun antenna element, and each include six planetary antenna elements that are disposed around said sun antenna element and that are spaced substantially equidistant from said sun antenna element and from each other; and said antenna include means, comprising said multiple-throw switch, for selectively achieving an electrically-switched array that includes said sun antenna element of one of said adjacent sub-arrays as a planetary antenna element, that includes at least one of said planetary antenna elements of said one adjacent sub-array as a sun element, and that includes at least one of said planetary elements of at least two other of said adjacent sub-arrays.

29. An antenna as claimed in claim 15 in which said interposing of said multiple-throw switch between said antenna elements and said single RF conductor comprises attaching said multiple-throw switch to seven of said antenna elements.

30. An antenna as claimed in claim 6 in which said antenna includes means for selectively amplifying signals received from at least one of said antenna elements in each of said groups using a single amplifier for each group.

31. An antenna as claimed in claim 6 in which said antenna includes means for selectively amplifying signals supplied to at least one of said antenna elements in each of said groups using a single amplifier for each group.

32. An antenna as claimed in claim 6 in which said antenna includes means for selectively interconnecting one of said phase shifters to any one of said antenna elements in each of said groups to shift signals received therefrom.

33. An antenna as claimed in claim 6 in which said antenna includes means for selectively interconnecting one of said phase shifters to any one of said antenna elements in each of said groups to shift signals supplied thereto.

34. An antenna as claimed in claim 15 in which said connecting means comprises a RF power combiner.

35. An antenna as claimed in claim 15 in which said connecting means comprises a RF power divider.

36. An antenna as claimed in claim 15 in which said antenna elements are disposed on a curved surface.

37. An antenna as claimed in claim 15 in which said antenna elements are disposed on a spherically shaped or curved surface.

38. An antenna as claimed in claim 15 in which said antenna provides uniform coverage means for electomagnetic energy over a wide field of view in azimuth and elevation.

39. An antenna array, as claimed in claim 5, wherein:

the number of phase shifters is seven.

40. An antenna array, as claimed in claim 6 wherein said number of groups is seven.

* * * * *